US012692811B2

(12) United States Patent
Daggolu et al.

(10) Patent No.: US 12,692,811 B2
(45) Date of Patent: Jul. 28, 2026

(54) SYSTEMS AND METHODS TO ASSESS STATE-OF-HEALTH OF AN EXHAUST GAS CONSTITUENT CAPTURE DEVICE

(71) Applicant: Cummins Inc., Columbus, IN (US)

(72) Inventors: Prashant Reuben Daggolu, Columbus, IN (US); Richard J. Ancimer, Toronto (CA); J. Steven Kolhouse, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 18/979,362

(22) Filed: Dec. 12, 2024

(65) Prior Publication Data

US 2025/0198321 A1 Jun. 19, 2025

Related U.S. Application Data

(60) Provisional application No. 63/609,761, filed on Dec. 13, 2023.

(51) Int. Cl.

| | |
|---|---|
| ***F01N 11/00*** | (2006.01) |
| ***F01N 3/08*** | (2006.01) |
| ***F01N 9/00*** | (2006.01) |

(52) U.S. Cl.

CPC ..... *F01N 11/00* (2013.01); *F01N 3/0814* (2013.01); *F01N 3/0885* (2013.01); *F01N 9/007* (2013.01); *F01N 11/007* (2013.01); *F01N 2550/00* (2013.01); *F01N 2550/02* (2013.01); *F01N 2550/03* (2013.01); *F01N 2550/20* (2013.01); *F01N 2550/22* (2013.01); *F01N 2900/16* (2013.01); *F01N 2900/1622* (2013.01)

(58) Field of Classification Search

CPC .... F01N 3/0814; F01N 3/0885; F01N 3/2889; F01N 9/007; F01N 11/00; F01N 11/007; F01N 2240/02; F01N 2550/00; F01N 2550/02; F01N 2550/03; F01N 2550/04; F01N 2550/20; F01N 2550/22; F01N 2560/022; F01N 2560/026; F01N 2560/028; F01N 2900/04; F01N 2900/16; F01N 2900/1621; F01N 2900/1622

See application file for complete search history.

(56) References Cited

U.S. PATENT DOCUMENTS

| | | | | |
|---|---|---|---|---|
| 8,201,444 | B2 | 6/2012 | Wang et al. | |
| 8,660,672 | B1 | 2/2014 | Hyde et al. | |
| 8,938,950 | B2 * | 1/2015 | Svihla | F01N 11/002 60/311 |
| 10,690,033 | B1 * | 6/2020 | Johnson | F01N 3/035 |
| 11,319,857 | B2 | 5/2022 | Lundström et al. | |

(Continued)

*Primary Examiner* — Binh Q Tran

(74) *Attorney, Agent, or Firm* — Foley & Lardner LLP

(57) ABSTRACT

A system includes an exhaust gas constituent capture device and a controller coupled to the capture device. The controller is configured to receive data regarding the capture device. The data includes at least one output value. The controller is also configured to determine a predicted output value regarding the capture device. The controller is also configured to determine a state of health of the capture device based on comparing the at least one output value with the at least one predicted output value. The controller is also configured to enable controls to mitigate degradation of the capture device, responsive to determining that the state of health of the capture device is at or below a threshold.

20 Claims, 3 Drawing Sheets

(56) References Cited

U.S. PATENT DOCUMENTS

| | | | | |
|---|---|---|---|---|
| 2009/0272099 | A1* | 11/2009 | Garimella | F01N 3/208 60/299 |
| 2010/0043400 | A1* | 2/2010 | Wang | F01N 11/002 60/299 |
| 2010/0287012 | A1 | 11/2010 | Ballantine et al. | |
| 2011/0099985 | A1* | 5/2011 | Yasui | F01N 3/208 60/287 |
| 2015/0218993 | A1* | 8/2015 | Chavannavar | F01N 3/208 422/111 |
| 2015/0337707 | A1* | 11/2015 | Nakamura | F01N 9/00 60/301 |
| 2017/0051654 | A1* | 2/2017 | Gupta | F01N 13/0093 |
| 2020/0095916 | A1* | 3/2020 | Haas | F02D 41/1465 |
| 2023/0417165 | A1* | 12/2023 | Kimura | F01N 3/24 |

* cited by examiner

SYSTEMS AND METHODS TO ASSESS STATE-OF-HEALTH OF AN EXHAUST GAS CONSTITUENT CAPTURE DEVICE

CROSS-REFERENCE TO RELATED APPLICATION

This application claims the benefit and priority to U.S. Provisional Application No. 63/609,761, filed on Dec. 13, 2023, which is incorporated herein by reference in its entirety and for all purposes.

TECHNICAL FIELD

The present disclosure relates to exhaust aftertreatment systems. More particularly, the present disclosure relates to systems and methods for diagnosing and controlling exhaust aftertreatment systems and, particularly, exhaust gas constituent capture devices and/or systems, such as carbon capture devices.

BACKGROUND

An engine may be coupled to an exhaust aftertreatment system to reduce harmful exhaust gas constituents such as nitrogen oxides (NOx), sulfur oxides (SOx), carbon oxides (e.g., CO and/or $CO_2$), particulate matter, etc. The aftertreatment system may include a filter or other component to remove particulate matter. The aftertreatment system may include a catalyst member to convert nitrogen oxides into nitrogen gas and water vapor. Over time, one or more components of the exhaust aftertreatment system may degrade. To mitigate decreased performance of the exhaust aftertreatment system, and to prevent an increase in harmful exhaust gas constituent emissions, it is desirable to perform maintenance on degraded components and/or replace degraded components. However, each component in an exhaust aftertreatment system may not degrade at the same rate due to manufacturing differences and transient conditions within the exhaust aftertreatment system (e.g., resulting from changes in engine parameters and operations conditions). One or more degradation mitigation actions may be taken to mitigate component degradation, such as repair or replacement of a component and/or adjusting engine or aftertreatment system operation to mitigate degradation.

SUMMARY

One embodiment relates to a system for monitoring and diagnosing an exhaust gas treatment device. The system includes at least one exhaust gas constituent capture device and a controller coupled to the at least one exhaust gas constituent capture device, the controller comprising at least one processor and at least one memory device storing instructions therein that, when executed by the at least one processor, cause the controller to perform operations. The operations include: receiving data regarding the at least one exhaust gas constituent capture device, the data comprising at least one output value; determining at least one predicted output value regarding the at least one exhaust gas constituent capture device; comparing the at least one output value with the at least one predicted output value; determining a state of health of the at least one exhaust gas constituent capture device based on the comparison; and responsive to determining that the state of health of the at least one exhaust gas constituent capture device is at or below a predetermined threshold, enabling one or more controls to mitigate degradation of the at least one exhaust gas constituent capture device.

Another embodiment relates to a method of assessing a state of health of at least one exhaust gas constituent capture device. The method includes: receiving data regarding the at least one exhaust gas constituent capture device, the data comprising at least one output value; determining at least one predicted output value regarding the at least one exhaust gas constituent capture device; comparing the at least one output value with the at least one predicted output value; determining a state of health of the at least one exhaust gas constituent capture device based on the comparison; and responsive to determining that the state of health of the at least one exhaust gas constituent capture device is at or below a predetermined threshold, enabling one or more controls to mitigate degradation of the at least one exhaust gas constituent capture device.

Still another embodiment relates to a method of identifying a tampering of an exhaust gas constituent capture device. The method includes: receiving data regarding the exhaust gas constituent capture device, the data comprising at least one output value; comparing the at least one output value to a previous corresponding output value; determining that the exhaust gas constituent capture device has been tampered with based on the comparison; and responsive to determining that the exhaust gas constituent capture device has been tampered with, providing a notification indicating the tampering of the exhaust gas constituent capture device.

Numerous specific details are provided to impart a thorough understanding of embodiments of the subject matter of the present disclosure. The described features of the subject matter of the present disclosure may be combined in any suitable manner in one or more embodiments and/or implementations. In this regard, one or more features of an aspect of the invention may be combined with one or more features of a different aspect of the invention.

Moreover, additional features may be recognized in certain embodiments and/or implementations that may not be present in all embodiments or implementations.

DETAILED DESCRIPTION

Figure 1:
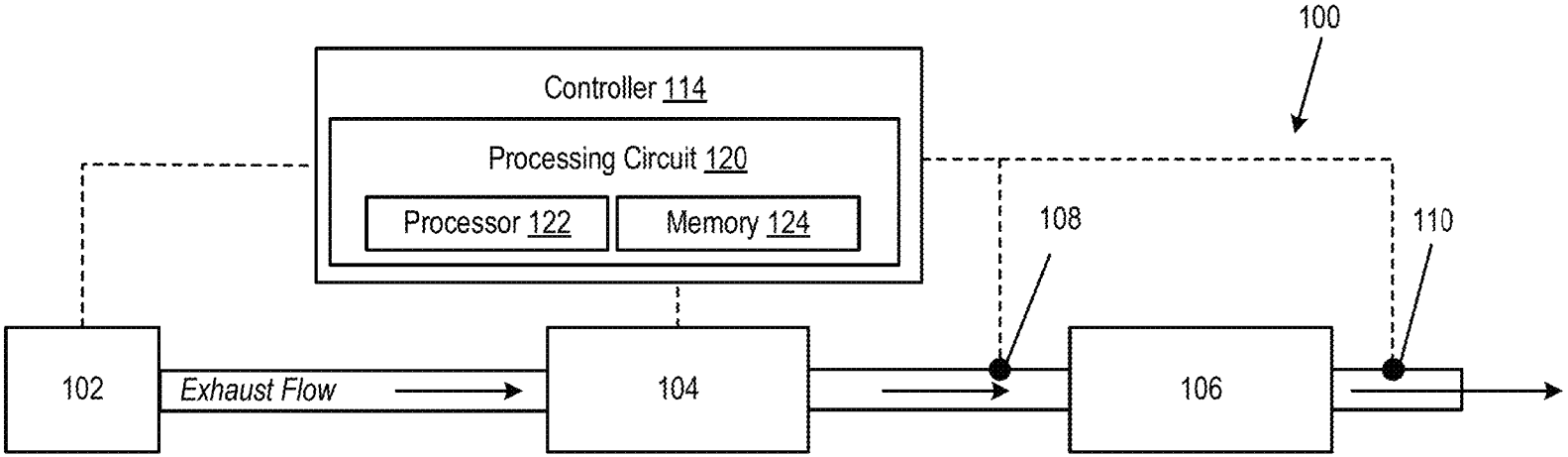
FIG. 1 is a diagram of a system for monitoring and diagnosing an exhaust aftertreatment system, such as an exhaust gas constituent capture device or system of the exhaust aftertreatment system, according to an example embodiment.

Following below are more detailed descriptions of various concepts related to, and implementations of, methods, apparatuses, and systems for management of an exhaust aftertreatment system including an exhaust gas constituent capture device and, particularly a carbon capture device. Before turning to the Figures, which illustrate certain exemplary embodiments in detail, it should be understood that the present disclosure is not limited to the details or methodology set forth in the description or illustrated in the Figures. It should also be understood that the terminology used herein is for the purpose of description only and should not be regarded as limiting.

As used herein, a "parameter," "parameter value," and similar terms, in addition to the plain meaning of these terms, refer to an input, output, or other value associated with a component and/or system of the implementations described herein. For example, a parameter may include a sensor value detected by an actual sensor or determined by a virtual sensor. A parameter may include a value, control setting, or other control signal used by a control system to control one or more components of the systems described herein. Thus, a parameter may include data or information.

As described herein, a system may include an engine coupled to an exhaust aftertreatment system, such that the exhaust aftertreatment system is in exhaust gas receiving communication with the engine. The exhaust aftertreatment system may include one or more components, such as a particulate filter configured to remove particulate matter, such as soot, from exhaust gas flowing in an exhaust gas conduit system, a dosing module (e.g., a doser) configured to supply a dosing fluid to the exhaust gas flowing in the exhaust gas system, and one or more catalyst devices configured to facilitate conversion of various exhaust gas constituents (e.g., nitrogen oxides, $NO_x$) to less harmful elements (e.g., water, nitrogen), such as a diesel oxidation catalyst, a selectively catalytic reduction (SCR) system, a three-way catalyst, and so on.

The system may also include an exhaust gas constituent capture device, and namely a carbon capture device. The carbon capture device or system is structured or configured to remove carbon dioxide from exhaust gas. The carbon capture device may be included in the exhaust aftertreatment system or be a separate component relative to a packaged/assembled existing exhaust aftertreatment system (e.g., positioned downstream or upstream of the exhaust aftertreatment system). That way, the carbon capture device may be configured as an add-on component/system for existing exhaust aftertreatment systems.

The system may also include a controller communicably coupled to at least the aforementioned components. The controller may be structured or configured to receive data or information from one or more sensors, and monitor one or more parameters of the components of the system using the one or more sensors (e.g., actual sensors and/or virtual sensors). The controller may analyze the sensor data and compare the analyzed sensor data with one or more predicted values. The controller may use the comparison to assess the state-of-health of the carbon capture device.

In an example scenario, a controller utilizes one or more sensors (e.g., real sensors and/or virtual sensors) to detect one or more operating parameters of a system. The one or more operating parameters may include a carbon capture device inlet value and/or a carbon capture device outlet value.

The carbon capture device inlet value may include one or more of a carbon capture device inlet temperature (e.g., via a temperature sensor positioned proximate the inlet), a carbon capture device inlet pressure (e.g., via a pressure sensor positioned proximate the inlet), a carbon capture device inlet oxygen level (e.g., via an oxygen sensor positioned proximate the inlet), a carbon capture device inlet carbon dioxide value (e.g., an amount such as via a carbon dioxide sensor), a carbon capture device inlet flow value (e.g., an exhaust gas mass flow rate via a flow rate sensor positioned proximate the inlet), a carbon capture device inlet humidity value (e.g., via a humidity sensor positioned proximate the inlet), and/or a carbon capture device inlet lambda value (e.g., via a lambda sensor which may include or be an oxygen sensor positioned proximate the inlet, a voltage or resistance lambda sensor that utilizes reference air sample in the sensor to determine a lambda value, etc.). The one or more operating parameters may also include a carbon capture device outlet value.

The carbon capture device outlet value may include one or more of a carbon capture device outlet temperature (e.g., via a temperature sensor positioned proximate an outlet), a carbon capture device outlet pressure (e.g., via a pressure sensor positioned proximate an outlet), a carbon capture device outlet oxygen level (e.g., via an oxygen sensor positioned proximate an outlet), a carbon capture device outlet carbon dioxide value (e.g., amount that is captured via a carbon dioxide sensor positioned proximate an outlet), a carbon capture device outlet mass flow rate value (e.g., via an exhaust gas mass flow rate sensor positioned proximate an outlet), a carbon capture device outlet humidity value (e.g., via a humidity sensor positioned proximate an outlet), and/or a carbon capture device outlet lambda value (e.g., via a lambda sensor which may include or be an oxygen sensor positioned proximate the inlet, a voltage or resistance lambda sensor that utilizes reference air sample in the sensor to determine a lambda value, etc.).

The controller may generate and/or receive a predicted carbon capture device inlet value and/or a predicted carbon capture device outlet value. The controller may use one or more models (e.g., a statistical model, a mathematical model, a machine learning model, etc.) and/or a look-up table to determine the predicted carbon capture device inlet value and/or the predicted carbon capture device outlet value. The controller may analyze the sensor data collected, such as using one or more of a lookup table or other statistical model (e.g., a regression model, a machine learning model, etc.). The controller may determine, based on comparing one or more measured values to the generated or received predicted values, the state-of-health of the carbon capture device. The state-of-health determination may be provided, by the controller, as a notification. The notification may be in the form of a fault code depending on the severity of the state-of-health determination. The fault code may be accessed by a service tool coupled to the controller. The notification may be reported to a remote computing system for tracking purposes (e.g., of a fleet of equipment). The notification may be provided to one or more compliance agencies for third-party tracking purposes. Additionally, the controller may alter or control operation of the of engine (e.g., implement a derate or limp condition to decrease carbon content generation) and/or aftertreatment system (e.g., cause a regeneration)(i.e., one or more controls to mitigate degradation of the at least one exhaust gas constituent capture device). Thus, the controller may implement one or more controls to improve operation of the system and help with de-carbonization efforts. Additionally, if the state of health of the carbon capture device is determined to be below a threshold, the controller may provide a notification followed by an intrusive diagnostic to further diagnose why the state of health of the carbon capture device is below the threshold and attempt to isolate and identify the root cause. The controller may send the notification telematically to service personnel (via a telematics device). The intrusive diagnostic may act as a redundant check on the confidence of the state of health determination of the carbon capture device.

In some embodiments, the state of health of the carbon capture device may refer to a quantitative description of a performance of the carbon capture device. In some embodiments, the state of health of the carbon capture device may include an amount of carbon captured by the carbon capture device. The amount may be evaluated relative to an expected amount of carbon captured by the carbon capture device (e.g., a difference value, a percent difference value, etc.) to determine a state of health. In other embodiments, the state of health of the carbon capture device may be an amount of carbon captured by the carbon capture device relative to a predetermined carbon capture threshold (e.g., a difference, a percent difference, etc.). In some embodiments, the state of health of the carbon capture device may be determined based on a total amount of carbon captured (i.e., a static value and based on a storage capacity of the device) while in other embodiments the storage capacity may be based on various operating conditions (i.e., a dynamic assessment such as when certain temperature, pressure, etc. conditions are being experienced). For example, 100 grams of carbon capture may indicate a healthy carbon capture device while 70 grams of carbon capture may indicate an unhealthy carbon capture device during certain operating conditions. In this way, the indication that less than a predefined amount of carbon being captured (e.g., 70 grams versus 100 grams in the above example) indicates that something is preventing the device from capturing carbon as desired (e.g., particulate matter build-up, a dynamic condition of the system, etc.). In some embodiments, the state of health of the carbon capture device may be determined based on a rate of carbon captured while certain conditions are present (e.g., temperature, pressure, etc.). In some embodiments, the state of health of the carbon capture device may refer to a qualitative description of the performance of the carbon capture device. In some embodiments, the state of health includes a qualitative description of a relative health of the exhaust gas constituent capture device, such as "healthy," "not healthy," "relatively healthy," relatively less healthy," etc. In an example embodiment, a relatively smaller difference between the actual difference and the predicted difference corresponds to a healthier exhaust gas constituent capture device. For example, a difference of less than 10%, less than 5%, less than 1%, etc., corresponds to a healthier exhaust gas constituent capture device. Further, a relatively larger difference between the actual difference and the predicted difference corresponds to a less healthy exhaust gas constituent capture device. For example, a difference of greater than 10%, greater than 25%, greater than 33%, etc. corresponds to a relatively less healthy exhaust gas constituent capture device.

The systems, apparatuses, and methods described herein provide a technical solution to the technical problem of diagnosing one or more components of an exhaust aftertreatment system, such as a carbon capture device, to determine a state of health of one or more exhaust aftertreatment system component. Advantageously the one or more exhaust aftertreatment system component may reduce harmful exhaust gas emissions, such as greenhouse gases (GHG), carbon oxides (e.g., CO or $CO_2$), nitrogen oxides, etc. For example, one or more exhaust aftertreatment system components may facilitate removing carbon dioxide in exhaust gases to mitigate against unwanted carbon dioxide emissions. Advantageously, one or more controls may be enabled responsive to determining the state of health is below a predetermined threshold. The controls may include, for example, increasing or decreasing an exhaust gas temperature (e.g., by controlling one or more of a heater, a chiller, etc.) and/or adjusting the operation of the engine (e.g., increasing or decreasing an air-to-fuel ratio of the engine, reducing a maximum speed of the engine, etc.).

The systems, methods, and computer-readable media may be used to determine whether an exhaust gas constituent capture device has been tampered with in some embodiments. For example, a control system or controller may receive data regarding the exhaust gas constituent capture device. The data may include at least one output value, such as a pressure value or another suitable value. The control system may compare the at least one output value to a previous corresponding output value. For example, the control system may compare a current pressure value to a previous pressure value. The previous pressure value may correspond to a time period before a current time (e.g., 10 minutes ago, 20 minutes ago, 1 hour ago, etc.). The control system may determine that the exhaust gas constituent capture device has been tampered with based on the comparison. For example, the control system may determine that the exhaust gas constituent capture device has been tampered with based on determining that the current pressure value is less than the previous pressure value and/or that a difference between the current pressure value and the previous pressure value is greater than a predetermined threshold. Responsive to determining that the exhaust gas constituent capture device has been tampered with, the controller may provide a notification indicating that the exhaust gas constituent capture device has been tampered with or likely tampered with. This may be beneficial as an anti-tampering tool for vehicles. These and other technical advantages, features, and benefits are described more fully herein below.

Referring now to FIG. 1, a schematic diagram of a system for monitoring and diagnosing an exhaust aftertreatment system, such as an exhaust gas constituent capture device or system, is shown according to an example embodiment. As shown, the system 100 includes an engine 102 coupled to an exhaust aftertreatment system 104 and one or more exhaust gas constituent capture devices, shown as a carbon capture device 106. The one or more exhaust gas constituent capture devices may be configured to capture exhaust gas constituents other than carbon. Further, the system 100 may include more or different exhaust gas constituent capture devices than as shown in FIG. 1. The system 100 includes at least one inlet sensor 108 and at least one outlet sensor 110. The system 100 includes a controller 114 that is communicably coupled to each of the aforementioned components.

In some embodiments, the system 100 is included in a vehicle. The vehicle may be any type of on-road or off-road vehicle including, but not limited to, wheel-loaders, fork-lift trucks, line-haul trucks, mid-range trucks (e.g., pick-up truck, etc.), sedans, coupes, boats, and any other type of vehicle. In another embodiment, the system 100 may be embodied in a stationary piece of equipment, such as a power generator or genset. All such variations are intended to fall within the scope of the present disclosure.

In the configuration shown in FIG. 1, the engine 102 is an internal combustion engine (ICE). The engine may be of a variety of sizes and shapes (e.g., number of cylinders, displacement, etc.). The engine 102 may consume a carbonaceous fuel (e.g., diesel, gasoline, natural gas, etc.), which is combusted, to generate power. In some embodiments, the engine 102 may be part of a hybrid engine system having a combination of an internal combustion engine and at least one electric machine coupled to at least one battery (not shown). In some embodiments, the system 100 may be configured as a mild-hybrid powertrain, a parallel hybrid powertrain, a series hybrid powertrain, or a series-parallel powertrain.

As shown in FIG. 1, the aftertreatment system 104 is located downstream of the engine 102 and upstream the carbon capture device 106 such that exhaust gas may flow from the engine 102 through the aftertreatment system 104 and to the carbon capture device 106. In other embodiments, the aftertreatment system 104 may be located downstream the carbon capture device 106. In yet other embodiments, the aftertreatment system 104 may be combined with the carbon capture device 106.

The aftertreatment system 104 may be in exhaust-gas receiving communication with the engine 102. In one embodiment, the aftertreatment system 104 may be specific to a diesel-fueled compression-ignition engine. As such, the aftertreatment system 104 may include for example a diesel oxidation catalyst (DOC), a diesel particulate filter (DPF), and a selective catalytic reduction (SCR) system. In some embodiments, one or more of these systems and/or devices may be excluded (e.g., to accommodate different engine systems such as a gasoline engine system or a diesel aftertreatment system that does not utilize one or more of these components). In some embodiments, the aftertreatment system 104 may include an ammonia slip catalyst (ASC). The aftertreatment system 104 (e.g., DOC, the DPF, and the SCR) may be fluidly coupled by to the engine 102 by an exhaust gas conduit. The DOC may be structured to receive the exhaust gas from the engine 102 and to oxidize one or more exhaust gas constituents (e.g., hydrocarbons, carbon monoxide, etc.) in the exhaust gas. The DPF may be arranged or positioned downstream of the DOC and may be structured to remove particulates or particulate matter, such as soot, from exhaust gas flowing in the exhaust gas stream. The DPF may include an inlet, where the exhaust gas is received, and an outlet, where the exhaust gas exits after having particulate matter substantially filtered from the exhaust gas. In some implementations, the DPF or other components may be omitted and/or other components added (e.g., a second SCR system having an additional dosing unit or module, multiple DOCs, etc.). Additionally, the arrangement of components within the aftertreatment system 104 may be different in other embodiments (e.g., the DPF positioned downstream of the SCR and ASC).

In some embodiments, such as with the diesel fueled engine exhaust aftertreatment system, the aftertreatment system 104 may further include a reductant delivery system which may include a decomposition chamber (e.g., decomposition reactor, reactor pipe, decomposition tube, reactor tube, etc.) to convert a reductant into ammonia. The reductant may be, for example, urea, diesel exhaust fluid (DEF), Adblue®, a urea water solution (UWS), an aqueous urea solution (e.g., AUS32, etc.), and other similar fluids. The dosing module may include a reservoir, a pump, and a nozzle (and potentially other components or devices). The reservoir may be structured to store the reductant. The pump may be fluidly coupled to the reservoir and the nozzle by a dosing conduit and structured to pump the reductant from the reservoir to the nozzle. The nozzle may provide the reductant to the exhaust gas within the exhaust gas conduit. The reductant fluid may be added to the exhaust gas stream to aid in the catalytic reduction. The reductant may be injected upstream of the SCR generally (or in particular, the SCR catalyst) by the dosing module such that the SCR catalyst receives a mixture of the reductant and exhaust gas. The reductant droplets may then undergo the processes of evaporation, thermolysis, and hydrolysis to form gaseous ammonia within the decomposition chamber, the SCR catalyst, and/or the exhaust gas conduit system, which may leave the aftertreatment system 104.

As indicated above, the aftertreatment system 104 may include an oxidation catalyst (e.g., the DOC) fluidly coupled to the exhaust gas conduit system to oxidize one or more gas constituents (e.g., hydrocarbons, carbon monoxide, etc.) of the exhaust gas. In order to properly assist in this reduction, the DOC may be required to be at a certain operating temperature. In some embodiments, this certain operating temperature is approximately between 200-500° C. In other embodiments, the certain operating temperature is the temperature at which the conversion efficiency of the DOC exceeds a predefined threshold (e.g. the conversion of HC to less harmful compounds, which is known as the HC conversion efficiency).

The SCR may be configured to assist in the reduction of $NO_x$ emissions by accelerating a $NO_x$ reduction process between the ammonia and the $NO_x$ of the exhaust gas into diatomic nitrogen ($N_2$) and water ($H_2O$). If the SCR catalyst is not at or above a certain temperature, the acceleration of the NOx reduction process may be limited and the SCR may not be operating at a level of a desired conversion efficiency (i.e., a value indicative of an amount of reduction of $NO_x$ emissions, also referred to as "de$NO_x$ efficiency"). In some embodiments, this certain temperature is approximately 200-600° C. The SCR catalyst may be made from a combination of an inactive material and an active catalyst, such that the inactive material (e.g. ceramic substrate) directs the exhaust gas towards the active catalyst, which is any sort of material suitable for catalytic reduction (e.g. metal exchanged zeolite (Fe or Cu/zeolite), base metals oxides like vanadium, molybdenum, tungsten, etc.).

When ammonia in the exhaust gas does not react with the SCR catalyst (either because the SCR is below operating temperature or because the amount of dosed ammonia greatly exceeds the amount of $NO_x$), the unreacted ammonia may bind to the SCR catalyst, becoming stored in the SCR. This stored ammonia may be released from the SCR as the SCR warms, which may cause undesirable issues if the amount of ammonia released is chemically greater than the desired reaction amount of $NO_x$ passing through (i.e., more ammonia than needed for the amount of $NO_x$, which can lead to ammonia slip). In some embodiments, the ASC may be included and structured to address ammonia slip by removing at least some excess ammonia from the treated exhaust gas before the treated exhaust gas is released into the atmosphere. As exhaust gas passes through the ASC, some of unreacted ammonia (i.e., unreacted with $NO_x$) remaining in the exhaust gas may be partially oxidized to $NO_x$, which then may consequently react with the remaining unreacted ammonia to form $N_2$ gas and water. However, similar to the SCR catalyst, if the ASC is not at or above a certain temperature, the acceleration of the $NH_3$ reduction process may be limited and the ASC may not be operating at a level of efficiency to meet regulations or desired parameters. In some embodiments, this certain temperature is approximately 250-300° C.

As indicated above and as also shown, the system 100 includes an exhaust gas constituent capture device 106. The exhaust gas constituent capture device is structured or configured to remove, at least partially, one or more exhaust gas constituent species from the emitted exhaust gas. In the example depicted, the exhaust gas constituent capture device is a carbon capture device 106. In other embodiment, a different species capture device may be used.

The carbon capture device 106 is structured to reduce carbon dioxide emissions from the engine 102 by capturing carbon dioxide in the emitted exhaust gas. The carbon capture device 106 may include a capture medium to capture the carbon dioxide. In one embodiment, the capture medium may include a liquid medium. The liquid medium may be an amine-based solution including, but not limited to, a monoethanolamine solution. The amine-based solution may capture carbon dioxide from the exhaust gas, and the solution may be pumped into a separate chamber (not shown) and may be heated up. The amine-based solution may be heated up via electrical heating, an auxiliary burner, an engine based thermal management (e.g., increasing engine power output, etc.), and/or exhaust waste heat. For example, the solution may be heated up to a temperature of greater than 100 degrees Celsius, and particularly greater than 120 degrees Celsius. Additionally or alternatively, the solution may be pressurized. When heated or pressurized, the amine and the carbon dioxide may separate, and the carbon dioxide may be removed. The carbon dioxide may be compressed and stored until ready for disposal. The amine solution may be pumped back to capture device 106 to then capture more carbon dioxide from the exhaust gas. In another exemplary embodiment, the capture medium may include or be a solid medium. The solid medium may be a zeolite, and the zeolite may capture carbon dioxide from the exhaust gas. In another exemplary embodiment, the capture medium may include a membrane which captures carbon dioxide by trapping the carbon dioxide on the membrane. The membrane may be heated up via electrical heating, an auxiliary burner, engine based thermal management, and/or exhaust waste heat (and/or via other heating means). When heated or pressurized, the membrane and the carbon dioxide may separate, and the carbon dioxide may be removed. In another exemplary embodiment, the capture medium may include a membrane which captures carbon dioxide by allowing only the carbon dioxide to pass through the membrane.

The carbon dioxide may be captured and then stored in a removable tank. Once the carbon dioxide is stored inside the tank, the tank may be removed from the system 100. For vehicle applications, the tank may be an additional component on the vehicle. For stationary applications, the tank may be separate from the stationary equipment and may be coupled to multiple pieces of equipment. Further, for example, the tank containing carbon dioxide may be stored underground in these situations. In either situation, carbon dioxide emissions from internal combustion engines may be reduced.

The efficiency of the carbon capture device 106 may be at a maximum when exhaust entering the carbon capture device 106 is at a predefined temperature value or range of temperature values, such as at or approximately at room temperature. Specifically, the temperature range where the efficiency of the carbon capture device 106 may be at a maximum may be approximately 35 degrees Celsius to 55 degrees Celsius; in other embodiments and based on various conditions, the maximum efficiency temperature range may differ. This is in contrast to SCR or other catalyst efficiency that desire relatively hotter temperatures to operate as desired. In operation, temperature and mass flow rate of the exhaust gas may affect the efficiency of the carbon capture device 106. As temperature of the exhaust gas increases from room temperature, efficiency of the carbon capture device 106 may decrease. As indicated above, this attribute is largely opposite of certain other aftertreatment system components, such as the SCR. Typically, efficiency of an aftertreatment system increases as temperature of the exhaust gas increases since high exhaust gas temperatures promote catalytic activity. However, the efficiency of the carbon capture device 106 decreases as temperature of the exhaust gas increases. Additionally, as flow rate of the exhaust gas increases, the efficiency of the carbon capture device 106 may decrease.

In some embodiments, the carbon capture device 106 includes an internal temperature sensor that is configured to acquire data regarding a temperature of the exhaust gas within the carbon capture device 106. For example, the internal temperature sensor may measure a temperature at or within the carbon capture device 106. The measured temperature may correspond to (e.g., be equal to) the temperature of the exhaust gas within the carbon capture device 106.

As described above, the system 100 may include at least one inlet sensor 108 and at least one outlet sensor 110. The at least one inlet sensor 108 is disposed or positioned upstream of the carbon capture device 106 (e.g., between the aftertreatment system 104 and the carbon capture device 106). The at least one outlet sensor 110 is disposed downstream the carbon capture device 106. Upstream and downstream refer to an exhaust gas flow direction relative to the engine 102 (i.e., downstream of the engine 102).

The at least one inlet sensor 108 may be or include one or more of a temperature sensor, a pressure sensor, an oxygen sensor, a lambda sensor, a calorimeter sensor, a carbon dioxide sensor, a mass flow rate sensor, and/or a humidity sensor. In some embodiments, the system 100 includes a multitude of inlet sensors 108 that may be or include any of the preceding types of sensors. The at least one outlet sensor 110 may be or include one or more of a temperature sensor, a pressure sensor, an oxygen sensor, a lambda sensor, a calorimeter sensor, a carbon dioxide sensor, a flow rate sensor, or a humidity sensor. In some embodiments, the system 100 includes a multitude of outlet sensors 110 that may be or include any of the preceding types of sensors. The relative positioning of the at least one inlet and outlet sensors 108 and 110 is highly configurable and may change depending on the system configuration, for example.

Additional sensors may be also included with the system 100. The sensors may include engine-related sensors (e.g., torque sensors, speed sensors, pressure sensors, flowrate sensors, temperature sensors, fuel sensors such as a fuel injection amount or rate, etc.). The sensors may further include sensors associated with other components of the vehicle, such as the aftertreatment system 104 (e.g., NOx sensor, reductant dosing sensor to determine or acquire data indicative of a dosing amount and frequency, etc.).

The at least one inlet sensor 108 and/or the at least one outlet sensor 110 (or the other sensors included in the system 100) may be real or virtual (i.e., a non-physical sensor that is structured as program logic in the controller 114 that makes various estimations or determinations). For example, an engine speed sensor may be a real or virtual sensor arranged to measure or otherwise acquire data, values, or information indicative of a speed of the engine 102 (typically expressed in revolutions-per-minute). In comparison, the sensor may be coupled to the engine (when structured as a real sensor) and structured to send a signal to the controller 114 indicative of the speed of the engine 102. When structured as a virtual sensor, at least one input may be used by the controller 114 in an algorithm, model, lookup table, etc. to determine or estimate a parameter of the engine (e.g., power output, etc.). Any of the sensors described herein may be real or virtual.

The controller 114 is coupled, and particularly communicably coupled, to the at least one inlet sensor 108 and the at least one outlet sensor 110. Accordingly, the controller 114 is structured to receive data from the at least one inlet sensor 108 and/or the at least one outlet sensor 110 and provide instructions/information to the at least one inlet sensor 108 and/or the at least one outlet sensor 110. The received data may be used by the controller 114 to control one more components in the system 100 as described herein.

The controller 114 is structured to control, at least partly, the operation of the system 100 and associated sub-systems, such as the engine 102, the aftertreatment system 104, the at least one inlet sensor 108 and/or the at least one outlet sensor 110. Communication between and among the components may be via any number of wired or wireless connections. For example, a wired connection may include a serial cable, a fiber optic cable, a CAT5 cable, or any other form of wired connection. In comparison, a wireless connection may include the Internet, Wi-Fi, cellular, radio, etc. In one embodiment, a controller area network (CAN) bus provides the exchange of signals, information, and/or data. The CAN bus includes any number of wired and wireless connections. Because the controller 114 is communicably coupled to the systems and components of FIG. 1, the controller 114 is structured to receive data from one or more of the components shown in FIG. 1. The function of the controller 114 is further described in regard to FIG. 2.

As the components of FIG. 1 are shown to be embodied in the system 100, the controller 114 may be structured as one or more electronic control units (ECUs), such as one or more microcontrollers. The controller 114 may be separate from or included with at least one of a transmission control unit, an exhaust aftertreatment control unit, a powertrain control module, an engine control unit, an engine control module, etc.

The controller 114 may be a hardware unit, such as one or more electronic control units. As such, the controller 114 may be embodied as one or more circuitry components including, but not limited to, processing circuitry, network interfaces, peripheral devices, input devices, output devices, sensors, etc. In some embodiments, controller 114 may take the form of one or more analog circuits, electronic circuits (e.g., integrated circuits (IC), discrete circuits, system on a chip (SOCs) circuits, microcontrollers, etc.), telecommunication circuits, hybrid circuits, and any other type of "circuit." In this regard, the controller 114 may include any type of component for accomplishing or facilitating achievement of the operations described herein. For example, a circuit as described herein may include one or more transistors, logic gates (e.g., NAND, AND, NOR, OR, XOR, NOT, XNOR, etc.), resistors, multiplexers, registers, capacitors, inductors, diodes, wiring, and so on. The controller 114 may also include or be a programmable hardware device such as field programmable gate arrays, programmable array logic, programmable logic devices or the like. In some hardware unit configurations, the controller 114 may be geographically dispersed throughout separate locations in the vehicle (e.g., as multiple control units). Alternatively, and as shown, the controller 114 may be embodied in or within a single unit/housing.

As shown, the controller 114 includes at least one processing circuit 120 having at least one processor 122 coupled to at least one memory device 124. The controller 114 is structured to assess a state-of-health or health of an exhaust gas constituent capturing device or system, such as the carbon capture device 106. In some embodiments, the controller 114 may control one or more components and/or systems of the system 100.

In the example shown, the controller 114 includes the processing circuit 120 having the processor 122 and the memory device 124. The processing circuit 120 may be structured or configured to execute or implement the instructions, commands, and/or control processes described herein.

The processor 122 may be implemented as one or more single- or multi-chip processors, digital signal processors (DSPs), application specific integrated circuits (ASICs), field programmable gate arrays (FPGAs), and/or suitable processors (e.g., other programmable logic devices, discrete hardware components, etc. to perform the functions described herein). A processor may be a microprocessor, a group of processors, etc. A processor also may be implemented as a combination of computing devices, such as a combination of a DSP and a microprocessor, a plurality of microprocessors, one or more microprocessors in conjunction with a DSP core, or any other such configuration. In some embodiments, the one or more processors may be shared by multiple circuits included or coupled to the controller 114 (not shown). Alternatively or additionally, the one or more processors may be structured to perform or otherwise execute certain operations independent of one or more co-processors. In other example embodiments, two or more processors may be coupled via a bus to enable independent, parallel, pipelined, or multi-threaded instruction execution. All such variations are intended to fall within the scope of the present disclosure.

The memory device 124 (e.g., memory, memory unit, storage device) may include one or more memory devices (e.g., RAM, ROM, Flash memory, hard disk storage) for storing data and/or computer code for completing or facilitating the various processes, layers and modules described in the present disclosure. For example, the memory device 124 may include dynamic random-access memory (DRAM). The memory device 124 may be communicably connected to the processor 122 to provide computer code or instructions to the processor 122 for executing at least some of the processes described herein. Moreover, the memory device 124 may be or include tangible, non-transient volatile memory or non-volatile memory. Accordingly, the memory device 124 may include database components, object code components, script components, or any other type of information structure for supporting the various activities and information structures described herein.

The memory device 124 may be or include machine or computer-readable media storing instructions that are executable by a processor, such as processor 122. As described herein and amongst other uses, the machine-readable media facilitates performance of certain operations to enable reception and transmission of data. For example, the machine-readable media may provide an instruction (e.g., command, etc.) to, e.g., acquire data. In this regard, the machine-readable media may include programmable logic that defines the frequency of acquisition of the data (or, transmission of the data). The computer readable media instructions may include code, which may be written in any programming language including, but not limited to, Java or the like and any conventional procedural programming languages, such as the "C" programming language or similar programming languages. The computer readable program code may be executed on one processor or multiple remote processors. In the latter scenario, the remote processors may be connected to each other through any type of network (e.g., CAN bus, etc.).

In an example embodiment, the controller 114 is configured to execute one or more instructions stored by the memory device 124 to perform operations to, for example, monitor and diagnose an exhaust gas treatment device, such as at least one exhaust gas constituent capture device 106. The controller 114 may receive data regarding the at least one exhaust gas constituent capture device 106. The data may include at least one input value and/or at least one output value. The controller 114 may determine at least one predicted input value and/or at least one predicted output value regarding the at least one exhaust gas constituent capture device 106. The controller 114 may compare the at least one input value and/or the at least one output value with the at least one predicted input value and/or the at least one predicted output value. The controller 114 may determine a state of health of the at least one exhaust gas constituent capture device 106 based on the comparison. In some embodiments, the controller 114 may enable one or more controls to mitigate degradation of the at least one exhaust gas constituent capture device, responsive to determining that the state of health of the at least one exhaust gas constituent capture device is at or below a predetermined threshold.

In some embodiments, the controller 114 may also receive data including at least one input value. The controller 114 may determine at least one predicted input value. The controller 114 may compare the at least one input value with the at least one predicted input value.

In some embodiments, the controller 114 may receive the at least one input value and the at least one output value from a sensing device including at least one of a temperature sensor, a pressure sensor, an oxygen sensor, a lambda sensor, a calorimeter sensor, a carbon dioxide sensor, a flow rate sensor, and a humidity sensor.

In some embodiments, when the system 100 includes at least one cooling device, such as the chiller 112. In other embodiments, a passive heat exchanger may be utilized. The controller 114 may mitigate degradation of the at least one exhaust gas constituent capture device by activating the cooling device according to one or more predetermined cooling device parameters. In some embodiments, the controller 114 may mitigate degradation of the at least one exhaust gas constituent capture device by adjusting operation of an engine 102. Adjusting operation of the engine may include at least one of reducing a maximum speed of the engine or reducing an amount of fuel provided to the engine relative to an amount of air provided to the engine.

In some embodiments, the controller 114 may compare the at least one input value relative to the at least one output value with the at least one predicted input value relative to the at least one predicted output value. The controller 114 may determine the state of health of the at least one exhaust gas constituent capture device based on the comparison. In some embodiments, the at least one outlet value is a carbon capture device outlet value. In some embodiments, the at least one predicted outlet value is a predicted carbon capture device outlet value. Each of the aforementioned values are described herein, with respect to FIG. 3.

In some embodiments, the controller 114 may perform an anti-tampering method or process to determine whether the carbon capture device 106 has been tampered with. One example may include analyzing a pressure drop across the carbon capture device 106 by the controller 114 (e.g., based on data from one or more pressure sensors proximate the carbon capture device 106). If there is not a pressure differential (e.g., based on a pressure sensor positioned by the device 106), then the controller 114 may determine that the carbon capture device 106 has been removed and provide a notification (e.g., to remote personnel, by generating a fault code or indicator lamp, etc.).

Another example anti-tampering process may include analyzing liquid solvents by the controller 114. In use, the carbon capture device 106 may require a separate tank/reservoir and the use of liquid solvents (e.g., amine formulations). Accordingly, the controller 114 may detect an empty liquid solvent tank (or having a fluid level below a predefined value which may be equated to "empty") during operation of the carbon capture device 106. Detecting an empty solvent tank during operation of the carbon capture device 106 may be an indication of tampering. Additionally, the controller 114 may include detect inactivity of the system 100 (e.g., temperatures, pressures, pumps, etc.) during operation, which may be indicative of tampering.

Another example anti-tampering process that may be employed by the controller 114 includes monitoring a fuel economy of the system 100 (e.g., a vehicle embodying the system). The use of a carbon capture device 106 may result in a fuel economy reduction via increased backpressure and/or parasitic loading on the engine. In some embodiments, the anti-tampering method executed by the controller 114 may include detecting changes (e.g., reductions beyond a threshold amount) in parasitic loading, which could be an indication of tampering. The controller 114 may also receive information regarding an indication of a reduced usage of the carbon capture device 106 gas compressors and/or significant improvements in vehicle fuel economy (over a predefined amount, which may be in relation to a fixed route). Each of these situations may also be an indication of tampering (together or independent of each other). Moreover and because usage of a carbon capture device 106 may result in a fuel economy penalty due to increased backpressure and/or parasitic loading on the engine 102, improvements in vehicle fuel economy (e.g., above a predefined value or threshold) may indicate tampering of the carbon capture device 106.

Still another example anti-tampering process that may be employed and utilized by the controller 114 may be examining system efficiencies. For example, the anti-tampering method of the controller 114 may include detecting a lower-than-expected efficiency of the carbon capture device 106 as that may indicate tampering. Additionally or alternatively, the anti-tampering method of the controller 114 may include detecting a higher-than-expected efficiency of the carbon capture device 106 as that may indicate tampering.

Yet another example anti-tampering process that may be employed and utilized by the controller may be utilizing diagnostic checks. For example, the controller 114 may detect higher-than-expected error when comparing actual and expected output performance when exposed to known inputs. This check may be indicative of tampering.

Still yet another example anti-tampering process that may be employed and utilized by the controller 114 includes the use of continuity events. For example, the controller may perform cumulative tracking and compare continuity breaks in the carbon capture device 106 circuit relative to known service events involving the carbon capture device 106. This method may include continuous monitoring of the carbon capture device 106 circuit during the periods when the system 100 is not operating (e.g., "key OFF"periods"). That is, a change in the continuity of the carbon capture device 106 circuit when the system 100 is not operating may be indicative of tampering. This process of continuity monitoring may represent a useful anti-tampering process for various emissions components and systems.

Figure 2:
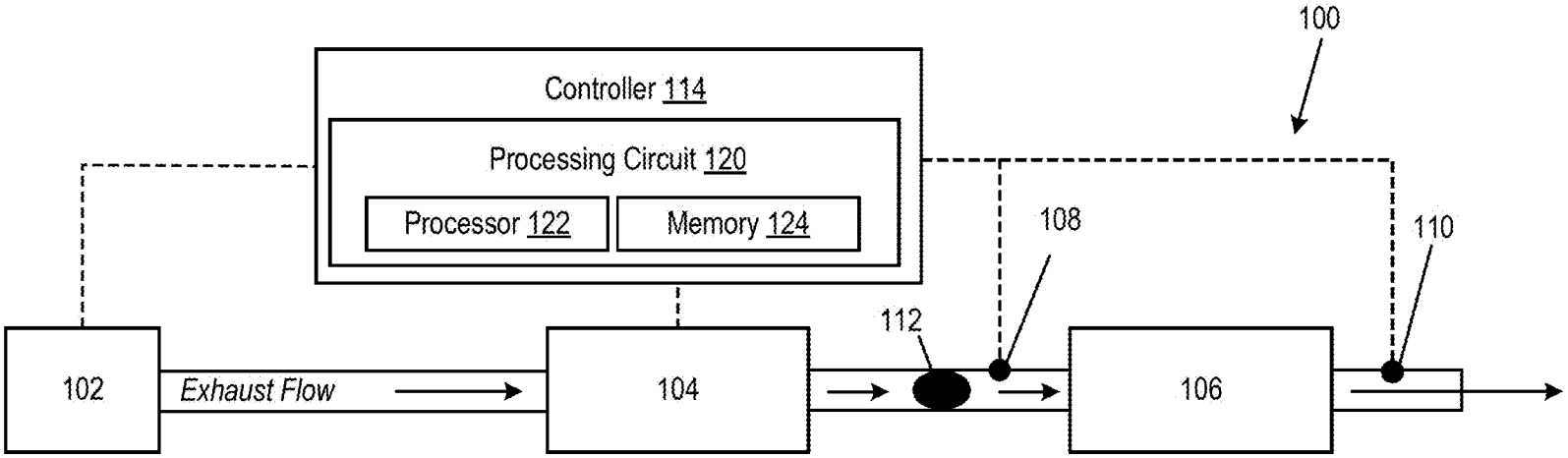
FIG. 2 is a diagram of a system for monitoring and diagnosing an exhaust aftertreatment system, such as an exhaust gas constituent capture device or system of the exhaust aftertreatment system, according to another exemplary embodiment.

Now referring to FIG. 2, the system 100 is shown according to another example embodiment. Relative to the system 100 of FIG. 1, in FIG. 2, the system 100 is shown to include a heat exchanger, shown as a cooler or chiller 112, positioned upstream the carbon capture device 106. More particularly and as shown in FIG. 2, the chiller 112 is disposed between the aftertreatment system 104 and the carbon capture device 106. Specifically, when the aftertreatment system 104 is located upstream the carbon capture device 106, a cooler or chiller 112 may be located between the aftertreatment system 104 and the carbon capture device 106.

The chiller 112 is structured to cool the exhaust gas from the aftertreatment system 104 before entering the carbon capture device 106. As mentioned above, relatively lower temperatures may promote efficiency with the carbon capture device 106. Therefore and beneficially, the chiller 112 may reduce the exhaust gas temperatures that are received by the carbon capture device 106 in order to keep the device 106 or attempt to keep the device 106 at a desired operating temperature range. The efficiency of the carbon capture device 106 may increase as the temperature of the carbon capture device 106 decreases (to a certain desired operating temperature range). The carbon capture device 106 reaction (i.e., reaction of the exhaust gas with the capture medium to remove the carbon dioxide) may have the highest efficiency at or around room temperature. Thus, the chiller 112 may increase the efficiency of the carbon capture device 106 by cooling the exhaust from the aftertreatment system 104 before entering the carbon capture device 106.

As indicated above, one more heat exchanger or temperature controlling devices may be included in the system 100. One heat exchanger includes the chiller 112 that may be structured to circulate a fluid (e.g., a coolant, such as a radiator fluid) that absorbs heat from the exhaust gas and cools the exhaust gas. For example, the chiller 112 may have a similar structure and function to an intake air chiller. In some embodiments, the cooler or chiller 112 may include fins or baffles to further help with heat transfer. In some embodiments, the chiller 112 may include or be coupled to a compressed air device. Another heat exchanger device may be a heat pump. The heat pump may extract heat and pump the heated medium (air) out of the system 100 (i.e., extract heat from the exhaust gas to cool it down).

Figure 3:
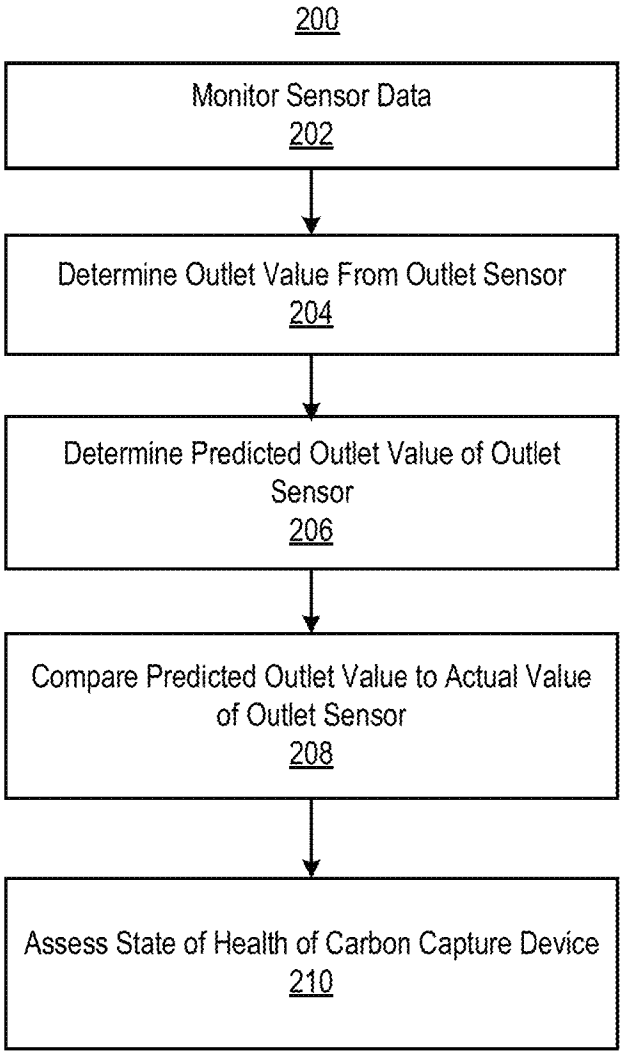
FIG. 3 is a flow diagram of a method for assessing a state-of-health of an exhaust gas constituent capturing device or system, such as a carbon capture device, according to an example embodiment.

Now referring to FIG. 3, a flow diagram of a method 200 of assessing the health of an exhaust gas constituent capture device is shown, according to an example embodiment. As described herein, the controller 114 may be structured to perform various processes of the method 200 in order to determine a state-of-health of an exhaust gas constituent capture device, such as the carbon capture device 106.

At process 202, sensor data is monitored. In particular, the controller 114 may monitor by receiving data or information from the at least one of the inlet sensor 108 and the at least one of the outlet sensor 110. Monitoring the inlet sensor 108 and the outlet sensor 110 may include receiving sensor data (e.g., operational parameters) from each of the inlet sensor 108 and the outlet sensor 110. The sensor data may include one or more operating parameters of the system 100. For example, the one or more operating parameters may include a carbon capture device inlet value and/or a carbon capture device outlet value. In another example, the one or more operating parameters may include other information described herein, such as information related to the anti-tampering processes described above.

The carbon capture device inlet value may include one or more of a carbon capture device inlet temperature (e.g., via a temperature sensor positioned proximate the inlet), a carbon capture device inlet pressure (e.g., via a pressure sensor positioned proximate the inlet), a carbon capture device inlet oxygen level (e.g., via an oxygen sensor positioned proximate the inlet), a carbon capture device inlet carbon dioxide value (e.g., an amount such as via a carbon dioxide sensor), a carbon capture device inlet flow (e.g., via a flow rate sensor positioned proximate the inlet), a carbon capture device inlet humidity value (e.g., via a humidity sensor positioned proximate the inlet), and/or a carbon capture device inlet lambda value (e.g., via a lambda sensor which may include or be an oxygen sensor positioned proximate the inlet, a voltage or resistance lambda sensor that utilizes reference air sample in the sensor to determine a lambda value, etc.). The one or more operating parameters may also include a carbon capture device outlet value.

The carbon capture device outlet value may include one or more of a carbon capture device outlet temperature (e.g., via a temperature sensor positioned proximate an outlet), a carbon capture device outlet pressure (e.g., via a pressure sensor positioned proximate an outlet), a carbon capture device outlet oxygen level (e.g., via an oxygen sensor positioned proximate an outlet), a carbon capture device outlet carbon dioxide value (e.g., amount that is captured via a carbon dioxide sensor positioned proximate an outlet), a carbon capture device outlet flow rate value (e.g., via a flow rate sensor positioned proximate an outlet), a carbon capture device outlet humidity value (e.g., via a humidity sensor positioned proximate an outlet), and/or a carbon capture device outlet lambda value (e.g., via a lambda sensor which may include or be an oxygen sensor positioned proximate the inlet, a voltage or resistance lambda sensor that utilizes reference air sample in the sensor to determine a lambda value, etc.).

At process 204, the controller 114 may determine at least one outlet value from the at least one outlet sensor 110. In some embodiments, a difference between the values from the at least one inlet sensor 108 and the at least one outlet sensor 110 is determined. More particularly, the controller 114 may determine an actual difference between at least one inlet value (e.g., measured by the at least one inlet sensor 108) and at least one outlet value (e.g., measured by the at least one outlet sensor 110). In one embodiment, the controller 114 determines a difference between an inlet value and an outlet value of the same type (e.g., an inlet and an outlet temperature value, an inlet and an outlet pressure value, etc.). In particular and in some embodiments, the controller 114 receives information regarding an inlet amount of carbon dioxide (e.g., via a carbon dioxide sensor) relative to an outlet amount of carbon dioxide (e.g., via a second carbon dioxide sensor) to determine an actual amount of an exhaust gas constituent captured by the exhaust gas constituent capture device 106. The amount may be an amount value (e.g., in grams) or may be a function of flow rate (e.g., grams/second), or be in another unit of measurement. In each case, the controller 114 may utilize one or more processes to determine or estimate an amount of captured exhaust gas by the carbon capture device 106.

At process 206, the controller 114 may determine at least one predicted outlet value regarding the at least one exhaust gas carbon capture device 106. In some embodiments, the controller 114 may also determine at least one predicted inlet value. The controller 114 may compare the at least one predicted inlet value and/or the at least one predicted outlet value. In particular, the controller 114 may determine a predicted difference between at least one predicted carbon capture device inlet value and the at least one predicted carbon capture device outlet value. In other embodiments, the controller 114 may determine a predicted difference between at least one predicted exhaust gas constituent capture inlet value and the at least one predicted exhaust gas constituent capture outlet value.

In some embodiments, the controller 114 may use one or more models (e.g., a statistical model, a mathematical model, a machine learning model, etc.) and/or a look-up table to determine one or more predicted carbon capture device inlet values and/or one or more predicted carbon capture device outlet values. The one or more predicted carbon capture device inlet values and/or one or more predicted carbon capture device outlet values may be based on various operating parameters of the system 100. For example, models and/or the lookup tables may utilize test data (e.g., acquired by performing a plurality of controlled tests) to correlate one or more engine system parameters (e.g., engine speed, air-to-fuel ratio, exhaust gas temperature, etc.) with one or more predicted carbon capture device inlet values and/or one or more predicted carbon capture device outlet values. The test data may include data for various engine system architectures and/or different engine system parameters (e.g., exhaust gas temperature, exhaust gas flow rate, engine speed, air-to-fuel ratio, etc.) that are representative of healthy and/or unhealthy carbon capture devices. For example, the carbon capture device 106 may be tested by varying temperature and flow rate of exhaust gas. The models and/or lookup tables may also incorporate data from non-controlled carbon capture devices 106. An amount of carbon dioxide that is removed by the carbon capture device 106 (e.g., at different temperatures, flow rates, etc.) may be recorded such that the one or more models or look-up tables include data regarding the amount of carbon dioxide that is removed by the carbon capture device 106 and correlate the data with the various engine system architectures and/or different engine system parameters. This information may be pushed over a network from a remote computing system that captured the test information to the controller 114 for use. The controller 114 may use the models and/or the lookup tables to determine the at least one predicted carbon capture device inlet value and the at least predicted carbon capture device outlet value and determine a difference between the at least one predicted carbon capture device inlet value and the at least predicted carbon capture device outlet value. In this way, the difference between at least one predicted carbon capture device inlet value and the at least predicted carbon capture device outlet value may be determined based on a function of an inlet flow rate and an inlet temperature.

At process 208, the controller 114 may determine a difference (e.g., an absolute difference, a percent difference, etc.) between the actual outlet value and the at least one predicted outlet value. In some embodiments, the controller 114 may receive the difference between an inlet value and an outlet value (e.g., the actual difference determined at step 204) and the difference between the one or more predicted carbon capture device inlet values and/or one or more predicted carbon capture device outlet values (e.g., the predicted difference, determined at step 206). In this way, the controller 114 may determine difference between the actual difference (determined at step 204) and the predicted difference (determined at step 206). Based on the difference, the controller 114 may determine (e.g., estimate) a storage capacity of the exhaust gas constituent device (e.g., carbon capture device). State of health may be based on the capacity of the exhaust gas constituent capture device and/or the efficiency determination. For example, a moving weighted average process may be used by the controller 114 to determine the state-of-health, such that when the moving weighted average of the efficiency drops below a predefined threshold, the controller 114 may make an unhealthy determination of the exhaust gas constituent device (and take one or more actions, such as initiate a regeneration process and/or provide a notification).

At process 210, a state-of-health is determined regarding the exhaust gas constituent device 106. In particular, at process 210, the controller 114 may determine, based on the comparison at process 208, a state-of-health of the exhaust gas constituent capture device. The state-of-health of the carbon capture device 106 may refer to a quantitative or qualitative description regarding the performance and/or operational capability of the carbon capture device.

In some embodiments, the state of health of the carbon capture device 106 is based on the difference between the actual outlet value and the at least one predicted outlet value determined at process 208. In some embodiments, the state of health of the carbon capture device 106 is based on the difference between the actual difference (e.g., an actual amount of an exhaust gas constituent captured by the exhaust gas constituent capture device) and the predicted difference (e.g., the predicted amount of an exhaust gas constituent captured by the exhaust gas constituent capture device) determined at process 208.

In some embodiments, the state of health of the carbon capture device is expressed as a quantitative value, such as a value of the difference between the actual difference and the predicted difference (determined at process 208). In other embodiments, the state of health of the carbon capture device may be the actual difference relative to a predetermined carbon capture threshold. The predetermined threshold may be equal to or based on the predicted amount of an exhaust gas constituent captured by the exhaust gas constituent capture device. In some embodiments, the state of health of the carbon capture device 106 may be determined based on a total amount of carbon captured while certain conditions are present (e.g., temperature, pressure, etc.). For example, 100 grams of carbon capture may indicate a healthy carbon capture device 106 while 70 grams of carbon capture may indicate an unhealthy carbon capture device 106. In some embodiments, the state of health of the carbon capture device 106 may be determined based on a rate of carbon captured while certain conditions are present (e.g., temperature, pressure, etc.).

In some embodiments, the state-of-health includes a qualitative description of a relative health of the exhaust gas constituent capture device, such as "healthy," "not healthy," "relatively healthy," relatively less healthy," etc. In an example embodiment, a relatively smaller difference between the actual difference and the predicted difference corresponds to a healthier exhaust gas constituent capture device. For example, a difference of less than 10%, less than 5%, less than 1%, etc., corresponds to a healthier exhaust gas constituent capture device. Further, a relatively larger difference between the actual difference and the predicted difference corresponds to a less healthy exhaust gas constituent capture device. For example, a difference of greater than 10%, greater than 25%, greater than 33%, etc. corresponds to a relatively less healthy exhaust gas constituent capture device.

After assessing the state of health of the carbon capture device 106, data regarding the state of health may be saved, uploaded to a server, and/or uploaded to compliance agencies by the controller 114. The data regarding the state of health may include, for example, the quantitative and/or qualitative state of health. In some embodiments, the data regarding the state of health may also include one or more of at least one inlet value, at least one outlet value, the actual difference between the at least one inlet value and the at least one outlet value, at least one predicted inlet value, at least one predicted outlet value, the predicted difference between the at least one predicted inlet value and the at least predicted outlet value, and/or other information regarding the state of health described herein.

In some embodiments, the controller 114 may provide data regarding the state of health to one or more remote computing systems, such as a server or other suitable third-party computing systems via a network. In some embodiments, the third-party computing systems may be owned by, operated by, or otherwise associated with a compliance agency, such as an environmental regulatory body or other government agency. In some embodiments, the controller 114 may provide data regarding the state of health to a remote computing system associated with a service provider. The service provider may be an original equipment manufacturer (OEM) of one or more components of the system 100, such as the engine 102, the exhaust aftertreatment system 104, the carbon capture device 106, and/or the controller 114. In these embodiments, the data regarding the state of health of the carbon capture device 106 is used to monitor a plurality of systems, including the system 100.

In some embodiments, responsive to determining that the state of health is at or below a predetermined threshold, the controller 114 may enable one or more controls to mitigate degradation (e.g., a decrease in the state of health) of the carbon capture device 106. In some embodiments, if the state of health of the carbon capture device 106 is below the predetermined threshold, the controller 114 may adjust (e.g., increase, decrease, or otherwise change) one or more operating parameters of the engine 102. For example, the controller 114 may cause the engine 102 to operate in a "limp mode" whereby a maximum speed of the engine is decreased to a predetermined value. In another example, the controller 114 may adjust the air-fuel ratio to decrease carbon content in the engine 102 (e.g., by decreasing an amount of fuel relative to an amount of air provided to the engine 102). In some embodiments, responsive to determining that the state of health is at or below the predetermined threshold, the controller 114 may activate the chiller 112. For example, the controller 114 may activate the chiller 112 according to one or more predetermined chiller operational parameters. The chiller operational parameters may include, but are not limited to a target temperature, a target heat dissipation (e.g., measured in watts, etc.), an amount of time the chiller 112 is activated relative to an amount of time the chiller 112 is deactivated, a timing of when the chiller 112 is activated relative to one or more engine operational parameters (e.g., engine speed, engine temperature, etc.), and/or other suitable chiller parameters. Advantageously, activating the chiller 112 may improve a performance of the carbon capture device 106.

In some embodiments, responsive to determining that the state of health of the carbon capture device 106 is at or below the predetermined threshold, the system 100 may enable, commence, and/or cause a regeneration sequence whereby the carbon capture device 106 is cleaned and/or performance is recovered (i.e., to recover more capacity for capturing and storing carbon). For example, if there is reversible poisoning, the system 100 may be put in a regeneration state to be cleaned. The regeneration sequence may include activating one or more heaters and/or opening a valve to purge the system 100 with air or inert gas. The air may have a low carbon dioxide concentration and may be at a high temperature (a temperature above a predefined threshold) to purge the system 100. The inert gas may be at a high temperature (a temperature above a predefined threshold) to purge the system 100. In some embodiments, the regeneration sequence or process may include opening a stored container of solvent and supplying a higher amount of solvent to the system 100 than what was initially provided. In some embodiments, the regeneration sequence may include making operating points more severe (e.g., higher pressures, lower adsorption temperatures, etc. relative to various predefined non-severe operating points). In some embodiments, the exhaust gas constituent capture device may be heated with clean air or onboard stored N2 to create a larger driving force for trace CO2 to be released from the material, especially for adsorbent and membranes.

In some embodiments, the controller 114 may provide a notification to a user responsive to determining that the state of health of the carbon capture device 106 is below the predetermined threshold. The notification may include illuminating one or more indicators, transmitting or otherwise providing a notification (e.g., text message, email, push notification, etc.) to a user device (e.g., personal computer, laptop, cell phone, etc.). In some embodiments, the notification may include activating one or more fault codes. In some embodiments, responsive to determining that the state of health of the carbon capture device 106 is at or below the predetermined threshold, the controller 114 may determine that an emissions credit of the system 100 may be adjusted. For example, the emissions credit of the system 100 may be decreased. Additionally, if the state of health of the carbon capture device 106 is determined to be below a threshold, the controller 114 may provide a notification followed by causing a diagnostic process, such as an intrusive diagnostic ("intrusive" signifying that one or more components or systems of the system 100 are caused to be operated a certain way (e.g., operating an engine at certain engine speeds) as part of the diagnostic, to further diagnose why the state of health of the carbon capture device 106 is below the threshold and isolate the cause of the fault. By actively manipulating operation of one or more components, the controller 114 may serially check various components until the system or component that may be responsible for the fault condition is identified. Additionally, the controller 114 may send the notification telematically to service personnel. The intrusive diagnostic can act as a redundant check on the confidence of the state of health of the carbon capture device 106.

In some embodiments, process 210 may also include processes for determining a rate of carbon capture (i.e., "carbon capture rate") of the exhaust gas constituent capture device. For example, the controller 114 may receive information from one or more sensors positioned upstream and/or downstream of the exhaust gas constituent device 106 (e.g., sensors 108 and 110). The sensors 108, 110 may provide information regarding an amount of exhaust gas constituent (e.g., carbon) entering the device 106 and an amount of exhaust gas constituent exiting the device 106. The one or more sensors may include at least one of a mass air flow (MAF) sensor, a carbon dioxide constituent sensor, a pressure sensor, and/or other suitable sensor. The information may include a mass flow rate of a gas stream passing through the exhaust gas constituent capture device, a carbon oxide concentration at the inlet of the exhaust gas constituent capture device, a carbon oxide concentration at the outlet of the exhaust gas constituent capture device, a pressure at the inlet of the exhaust gas constituent capture device, a pressure at the outlet of the exhaust gas constituent capture device, etc. The controller 114 may determine an estimated carbon capture rate based on the information from the sensors. For example, the controller 114 may use one or more models (e.g., mathematical models, machine learning models, etc.), a lookup table, and/or another process or tool that correlates the information received from the sensors with the estimated carbon capture rate. Additionally, the controller 114 may determine an expected carbon capture rate (e.g., a theoretical or ideal carbon capture rate), in some embodiments. For example, at a given mass flow rate and a storage capacity of the exhaust gas constituent capture device, the controller 113 may determine an expected carbon capture rate. The controller 114 may compare the estimated carbon capture rate to the expected carbon capture rate to assess a SOH of the exhaust gas constituent capture device.

It should be noted that the term "example" as used herein to describe various embodiments is intended to indicate that such embodiments are possible examples, representations, and/or illustrations of possible embodiments and such term is not intended to connote that such embodiments are necessarily extraordinary or superlative examples.

The terms "coupled," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Additionally, it should be understood that features from one embodiment disclosed herein may be combined with features of other embodiments disclosed herein as one of ordinary skill in the art would understand. Other substitutions, modifications, changes and omissions may also be made in the design, operating conditions and arrangement of the various exemplary embodiments without departing from the scope of the present invention.

While this specification contains many specific implementation details, these should not be construed as limitations on the scope of any inventions or of what may be claimed, but rather as descriptions of features specific to particular implementations of particular inventions. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. A system for monitoring and diagnosing at least one carbon capture device, the system comprising:

at least one carbon capture device; and a controller coupled to the at least one carbon capture device, the controller comprising at least one processor and at least one memory device storing instructions therein that, when executed by the at least one processor, cause the controller to perform operations comprising:

receiving data regarding the at least one carbon capture device, the data comprising at least one output value;

determining at least one predicted output value regarding the at least one carbon capture device;

comparing the at least one output value with the at least one predicted output value;

determining a state of health of the at least one carbon capture device based on the comparison; and responsive to determining that the state of health of the at least one carbon capture device is at or below a predetermined threshold, enabling one or more controls to mitigate degradation of the at least one carbon capture device.

2. The system of claim 1, wherein receiving the data regarding the at least one carbon capture device comprises receiving the at least one output value from a sensing device including at least one of a temperature sensor, a pressure sensor, an oxygen sensor, a lambda sensor, a calorimeter sensor, a carbon dioxide sensor, a flow rate sensor, and a humidity sensor.

3. The system of claim 1, further comprising at least one heat exchanger disposed upstream of the at least one carbon capture device.

4. The system of claim 3, wherein the at least one heat exchanger includes a chiller, and wherein the one or more controls to mitigate degradation of the at least one carbon capture device comprises activating the chiller.

5. The system of claim 1, wherein the one or more controls to mitigate degradation of the at least one carbon capture device comprises adjusting operation of an engine, the engine disposed upstream of the at least one carbon capture device, wherein adjusting operation of the engine comprises at least one of:

reducing a maximum speed of the engine, or reducing an amount of fuel provided to the engine relative to an amount of air provided to the engine.

6. The system of claim 1, wherein the instructions, when executed by the at least one processor, cause the controller to perform further operations comprising enabling a regeneration sequence responsive to determining that the state of health of the at least one carbon capture device is at or below the predetermined threshold, the regeneration sequence comprising:

activating one or more heaters positioned upstream of the at least one carbon capture device; and opening a valve upstream of the at least one carbon capture device, wherein the valve is configured to allow a gas to flow to the at least one carbon capture device when opened, and the one or more heaters are configured to heat the gas flowing to the at least one carbon capture device.

7. The system of claim 1, wherein the instructions, when executed by the at least one processor, cause the controller to perform further operations comprising:

receiving data comprising at least one input value;

determining at least one predicted input value;

comparing the at least one input value relative to the at least one output value with the at least one predicted input value relative to the at least one predicted output value; and determining the state of health of the at least one carbon capture device based on the comparison.

8. A method of assessing a state of health of at least one carbon capture device, comprising:

receiving data regarding the at least one carbon capture device, the data comprising at least one output value;

determining at least one predicted output value regarding the at least one carbon capture device;

comparing the at least one output value with the at least one predicted output value;

determining a state of health of the at least one carbon capture device based on the comparison; and responsive to determining that the state of health of the at least one carbon capture device is at or below a predetermined threshold, enabling one or more controls to mitigate degradation of the at least one carbon capture device.

9. The method of claim 8, further comprising:

receiving data comprising at least one input value; and determining at least one predicted input value.

10. The method of claim 9, wherein the state of health of the at least one carbon capture device is further based on comparing the at least one input value with the at least one predicted input value.

11. The method of claim 9, further comprising:

determining a carbon capture rate based on the at least one output value and at least one input value; and determining an expected carbon capture rate based on the at least one input value and a storage capacity of the at least one carbon capture device;

wherein the state of health of the at least one carbon capture device is further based on comparing the carbon capture rate with the expected carbon capture rate.

12. The method of claim 8, wherein the one or more controls to mitigate degradation of the at least one carbon capture device comprise adjusting operation of an engine, the engine disposed upstream of the at least one carbon capture device, wherein adjusting operation of the engine comprises at least one of:

reducing a speed of the engine, or reducing an amount of fuel provided to the engine relative to an amount of air provided to the engine.

13. The method of claim 8, further comprising enabling a regeneration sequence responsive to determining that the state of health of the at least one carbon capture device is at or below the predetermined threshold, the regeneration sequence comprising:

activating one or more heaters positioned upstream of the at least one carbon capture device; and opening a valve upstream of the at least one carbon capture device, wherein the valve is configured to allow a gas to flow to the at least one carbon capture device when opened, and the one or more heaters are configured to heat the gas flowing to the at least one carbon capture device.

14. The method of claim 13, wherein the gas is at least one of air or nitrogen gas.

15. A method of identifying tampering of an carbon capture device, comprising:

receiving data regarding the carbon capture device, the data comprising at least one output value;

comparing the at least one output value to a previous corresponding output value;

determining that the carbon capture device has been tampered with based on the comparison; and responsive to determining that the carbon capture device has been tampered with, providing a notification indicating the tampering of the carbon capture device.

16. The method of claim 15, wherein the at least one output value is a pressure value regarding a pressure change across the carbon capture device and the previous corresponding output value is a previous pressure value regarding a previous pressure change across the carbon capture device.

17. The method of claim 16, wherein determining that the carbon capture device has been tampered with is based on the pressure value being below the previous pressure value.

18. The method of claim 15, wherein:

the at least one output value is a fuel economy value regarding an engine positioned upstream of the carbon capture;

the previous corresponding output value is a previous fuel economy value regarding the engine; and determining that the carbon capture device has been tampered with is based on the fuel economy value being above the previous fuel economy value.

19. The method of claim 15, wherein:

the at least one output value is a fluid level value regarding a fluid tank configured to store a liquid solvent;

the previous corresponding output value is a previous fluid level value regarding the fluid tank; and determining that the carbon capture device has been tampered with is based on the fluid level value being below the previous fluid level value.

20. The method of claim 15, further comprising:

monitoring the carbon capture device during periods when a system including the carbon capture device is not operating;

comparing a continuity break in the carbon capture device relative to a known service event involving the carbon capture device; and determining that the carbon capture device has been tampered with is based on the comparison.

* * * * *